US007634885B2

(12) United States Patent
Hoffmann

(10) Patent No.: US 7,634,885 B2
(45) Date of Patent: Dec. 22, 2009

(54) WALL ELEMENT

(76) Inventor: Manfred Hoffmann, Hoffmann Dienstleistungen für die werbende Wirtschaft GmbH, Gretlade 5, D-31319 Sehnde/Höver (DE)

( * ) Notice: Subject to any disclaimer, the term of this patent is extended or adjusted under 35 U.S.C. 154(b) by 518 days.

(21) Appl. No.: 11/386,093

(22) Filed: Mar. 22, 2006

(65) Prior Publication Data

US 2006/0272254 A1 Dec. 7, 2006

Related U.S. Application Data

(63) Continuation of application No. PCT/EP2005/002246, filed on Mar. 3, 2005.

(51) Int. Cl.
*E04B 2/00* (2006.01)

(52) U.S. Cl. ..... 52/585.1; 52/641; 52/645; 52/655.1; 52/655.5; 52/656.5; 52/660; 52/582.1; 52/586.1; 52/236.9; 52/239; 52/64; 52/71; 160/351; 160/229.1; 160/230; 160/382; 160/383

(58) Field of Classification Search ..... 52/27, 52/36.1, 35.4–36.6, 633–648.1, 653.1, 656.2, 52/655.1, 660–669, 79.1, 79.12, 79.13, 585.1, 52/582.1, 586.1, 586.2, 236.9, 239, 64–71, 52/79.5, 656.4, 656.5; 160/194, 351, 135, 160/230, 371, 382, 383
See application file for complete search history.

(56) References Cited

U.S. PATENT DOCUMENTS 4,001,993 A * 1/1977 Daniels ..... 52/376
4,018,020 A * 4/1977 Sauer et al. ..... 52/241
4,094,114 A * 6/1978 Burcham ..... 52/481.2
4,571,907 A * 2/1986 DeFouw et al. ..... 52/239
4,905,428 A 3/1990 Sykes
4,910,932 A * 3/1990 Honigman ..... 52/280
5,305,567 A 4/1994 Wittler
5,381,845 A * 1/1995 Ruggie et al. ..... 160/135
5,408,796 A * 4/1995 Hashimoto et al. ..... 52/489.2
6,176,054 B1 * 1/2001 Allen et al. ..... 52/272
7,395,634 B2 * 7/2008 Anderson et al. ..... 52/79.1
7,427,053 B2 * 9/2008 Nawrocki ..... 248/220.21

FOREIGN PATENT DOCUMENTS

DE 83 37 738.7 6/1984
DE 27 59 598 C2 11/1986
DE 299 01 230 U1 9/1999
DE 20 2004 002 113 U1 5/2004

* cited by examiner

*Primary Examiner*—Jeanette E. Chapman
(74) *Attorney, Agent, or Firm*—Shlesinger, Arkwright & Garvey LLP

(57) ABSTRACT

Wall element 2, especially for constructing a partition wall, for example in an exhibition, has a first connecting device with a least one first connecting element 12 to establish a connection with at least one other wall element 2'. the first connecting device is configured such that one wall element 2 can be connected with another wall element 2' without tools. The wall element includes an essentially frame-like basic body 18 and a second connecting device for releasable connection of at least one flat face element 30, 32, 34 to the basic body. the second connecting device is configured so that the face element 30, 32, 34 can be connected-with the basic body 18 without tools. The wall element 2 allows the partition walls to be largely assembled without tools. This saves time and assembly costs.

13 Claims, 5 Drawing Sheets

WALL ELEMENT

CROSS-REFERENCE TO RELATED APPLICATION

This application is a continuation of application no. PCT/EP2005/002246, filed Mar. 3, 2005, and which is incorporated herein by reference.

FIELD OF THE INVENTION

The invention relates to a wall element. More particularly, the invention relates to a wall element having a first connecting device for connecting two such wall elements, and including a face element directly connected or connectable to a frame-like basic body of the wall element by a second connecting device.

BACKGROUND OF THE INVENTION

It is known to construct temporary partition walls at exhibitions from a plurality of wall elements by connecting them to create, for example, the sides of an exhibition stand. Such wall elements generally have an essentially rectangular shape and are made of extruded aluminum profiles; hence, their light weight makes it easy for them to be transported and handled.

To construct a partition from a plurality of wall elements, two wall elements must be positioned in relation to each other so that the connecting surfaces on the outside of two wall elements to be connected can contact each other. Screw elements are used to hold this connection between the two wall elements.

However, it takes a long time to construct a partition wall from such wall elements as two wall elements need to be connected with a plurality of screw connections, and this task needs to be repeatedly performed to create the desired length of a partition wall consisting of a plurality of wall elements.

Wall elements that in particular are used to create partition walls are, for example, known from DE 83 37 738 U1, DE 299 01 230 U1, and DE 27 59 598 C2.

DE 20 2004 002 113 U1 discloses a wall element of the relevant type that in particular is suitable for constructing a partition, for example, at an exhibition. The wall element disclosed in this document has a first connecting means with at least one first connecting element to establish a connection with another wall element. The first connecting means is designed such that one wall element can be connected with another wall element without tools. The prior-art wall element also has an essentially frame-like basic body and two connecting means for releasable connection of at least one flat face element with the basic body. The second connecting means can for example be formed by a screw connection.

The advantage of the wall element disclosed in the document is that two or a plurality of wall elements can be connected to form a partition wall without tools quickly, easily and economically.

OBJECTS AND SUMMARY OF THE INVENTION

An object of the invention is to provide a wall element including a face element directly connected or connectable to a frame-like basic body of the wall element that allows partition walls to be created more easily, quickly, and economically.

This object is achieved by the inventive wall element, which is especially suited for constructing a partition wall, for example in an exhibition, which has a first connecting device with a least one first connecting element to establish a connection with at least one other wall element. The first connecting device is configured such that one wall element can be connected with another wall element without tools. The wall element according to the invention also has an essentially frame-like basic body and a second connecting device for releasable connection of at least one flat face element to the basic body. Further, the second connecting device is configured so that the face element can be connected with the basic body without tools.

The basic idea of the teaching according to the invention is to connect two wall elements to form a partition wall without tools, and also to connect the face element(s) with the basic body. The teaching according to the invention provides that the second connecting device is configured such that the face element can be connected to the basic body without tools. A partition wall including a plurality of wall elements according to the invention can be constructed completely without tools, and this includes affixing the face elements. This saves a great deal of time and hence assembly costs.

A "face element" according to the invention is understood as a flat element which is affixed to the basic body of the wall element to give the wall element a flat surface and, in particular, a flat visual barrier and hence provide a visual or at least spatial separation.

To reduce the assembly time, it is sufficient according to the invention when two wall elements can be connected without tools, but a tool is required to disconnect them. An extremely advantageous development of the teaching according to the invention provides that a first connecting device is configured such that the wall element can be disconnected from another wall element without tools. In this embodiment, the connection is also released without tools to substantially reduce the disassembly time and hence the disassembly cost for the partition walls.

It is sufficient according to the invention when the face element is connectable to the basic body without tools, but a tool is required to separate them, for example to release a snap-in connection.

However, an extremely advantageous development of the teaching according to the invention provides that the second connecting device is configured such that the connection between the connecting element and the basic body can be separated without tools. In this manner, the connecting element or face element can be both joined with and removed from the basic body in a particularly fast and hence economical manner.

According to the invention, the face element(s) can be directly connected or connectable to the frame-like basic body of the wall element. An advantageous development of the teaching according to the invention provides however that the second fastening device has at least one holder for the face element, and the holder can be connected to the basic body without tools. In this embodiment, the process for affixing the face element is as follows: the holder is first connected to the frame-like basic body, and then the face element is connected to the holder. This makes tool-free assembly easy, which saves time and money.

An extremely advantageous development of the above-described embodiment provides that the holder is connectable to the basic body via a preferably releasable plug-in connection. In this embodiment, it is particularly easy to connect the holder to the basic body.

An advantageous development of the above-described embodiment provides that the basic body has a groove into which the insertion end of the holder can be inserted. This embodiment is particularly easy to construct.

In order for the holder to be firmly held in the groove when inserted, an advantageous development of the above-described embodiment provides that the holder is clamped in its insertion position in the groove.

To create a clamped connection between the holder and the groove when the holder is in inserted position in the above-cited embodiment, an advantageous development provides that the cross-section of the insertion end is substantially complementary with the cross-section of the groove. To achieve a clamping connection, the cross-section of the insertion end in this embodiment is somewhat larger than the cross-section of the groove in at least one dimension.

The shape, size, and material of the holder as well as the number of holders can vary widely. In order to make assembly easy and hence economical, an advantageous development provides that the holder is a profiled element. The profiled element can in particular be formed by an extruded aluminum profile or stock.

It is possible according to the invention to connect the holder with the basic body without tools, but join the face element with the holder via a connection that requires tools. To make joining the face element to the holder simpler and hence faster and more economical, a particularly advantageous development of the teaching according to the invention provides that the face element is connectable to the holder without tools.

In the above-cited embodiment, the tool-free connection of the face element to the holder can be created in any suitable manner, for example via a clamping or snap-in connection. An extremely advantageous development of the teaching according to the invention provides that the face element is connectable or connected to the holder with at least one hook-and-loop (e.g., VELCRO® ) connection. At least one hook part of the VELCRO® connection is on one of the components to be connected, and a least one loop part of VELCRO® connection is on the other components to be connected. In this embodiment, the face element can, for example, be mounted on the basic body by first connecting a holder or a plurality of holders to the basic body of the wall element via a plug-in connection. The holder(s) possess parts of a VELCRO® connection. Subsequently, the face element on which the complementary parts of a VELCRO® connection are located can be connected to the holder and hence to the basic body. These procedures are particularly fast and hence economical. To remove the face element from the basic body, the VELCRO® connection between the face element and holder(s) is first released. Subsequently, the holders can, for example, be released from the basic body by undoing a plug-in connection. According to the invention, the connection between the connecting element and holder is accordingly separated without tools.

Another extremely advantageous development of the teaching according to the invention provides that the first connecting device has clamping device. In this embodiment, the wall elements can be connected with a clamping connection. This makes it particularly easy and economical to create or separate the connection without tools.

To give the connecting element a simple and hence economical configuration, it is useful for the connecting element to have an essentially bracket-like or clamp-like configuration to form the clamping elements.

According to another embodiment of the teaching according to the invention, the connecting element has an essentially U-shaped cross-section. Such a connecting element can clamp parts of wall elements to be joined and thereby connect the wall elements. The connecting element can, for example, clamp a free edge of the two neighboring partition walls. It is, however, possible in particular to insert the connecting element into flush, window-like openings that are formed in adjacent parts of neighboring wall elements to be connected.

A variation of the embodiment with the bracket or clamp-like connecting element provides that the connecting element has two spaced and preferably essentially parallel legs that are preferably connected to each other in to another embodiment via a middle bar. Such connecting elements are particularly easy and hence economical to manufacture.

To have the connecting element itself form the clamping device in the embodiment with the clamping device and hence dispense with separate clamping device, it is useful for the legs to be elastic and hence form the clamping device. In this embodiment, the first connecting device according to the invention has a particularly simple and hence economical configuration.

Another advantageous embodiment provides that the wall element has a least one preferably window-like opening for receiving the connecting element. In this embodiment, the two neighboring wall elements can be connected easily and in an aesthetically pleasing manner with a least one bracket-like or clamp-like connecting element.

It is sufficient when the connecting element according to the invention is fixed in its assembled position, for example, by clamping. To prevent the connecting element from undesirably releasing, an advantageous embodiment of the teaching according to the invention provides that the first connecting element has snap-in device to hold the connecting element inserted in the opening.

The snap-in device is particularly easy to configure when the snap-in device have a snap-in opening, especially a borehole or notch in the wall element as provided in an advantageous embodiment. A snap-in projection in the connecting element snaps into the snap-in opening when in assembled position.

The shape, size and material of the wall element according to the invention can vary widely. To give the wall element a simple and economical light design, an advantageous development provides that the wall element is composed at least partially of extruded aluminum profiles or profiled stock.

The wall element is usefully rectangular.

Another advantageous embodiment provides that the connecting element includes bent sheet metal. In this embodiment, the connecting element is particularly easy and economical to manufacture.

In order to make it easier to separate the connecting element from the wall elements, an advantageous development of the embodiment having a connecting element with two legs provides that the free end of at least one of the legs has a bent or kinked end section so that the connecting element can be spread by gripping the end sections.

Advantageous and useful embodiments of the connecting element according to the invention are in greater detail below.

A partition wall according to the invention is set forth in detail below.

An exemplary embodiment of the invention will be explained in the following with reference to a highly schematic drawing. All of the features that are described or shown in the drawing form the subject of the invention both independently or in any combination, independent of their citation in the patent claims or their prior reference, and independent of their formulation or portrayal in the description and the drawing.

DETAILED DESCRIPTION OF THE INVENTION

In the figures, the same or corresponding components are given the same reference number.

The following discussion refers to FIGS. 1-4.

Figure 1:
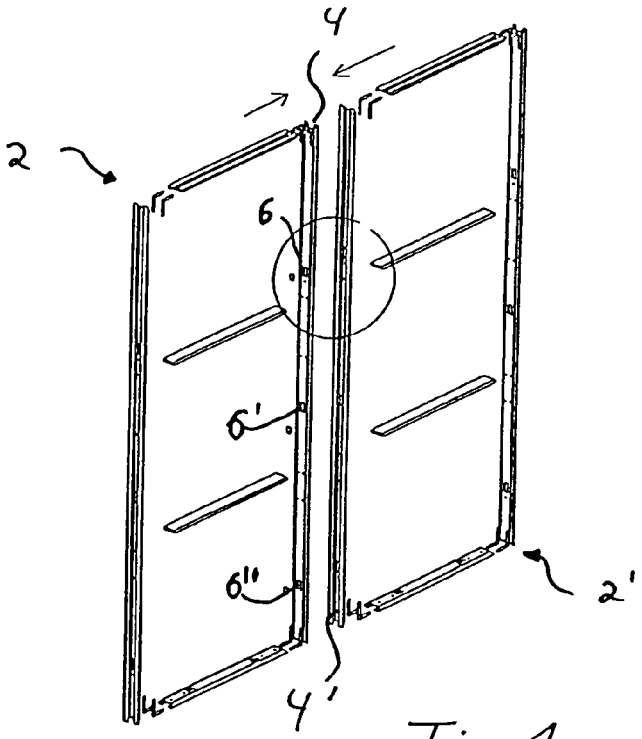
FIG. 1 is a perspective view of two wall elements according to the invention, in which face elements are omitted for clarity.
Figure 2:
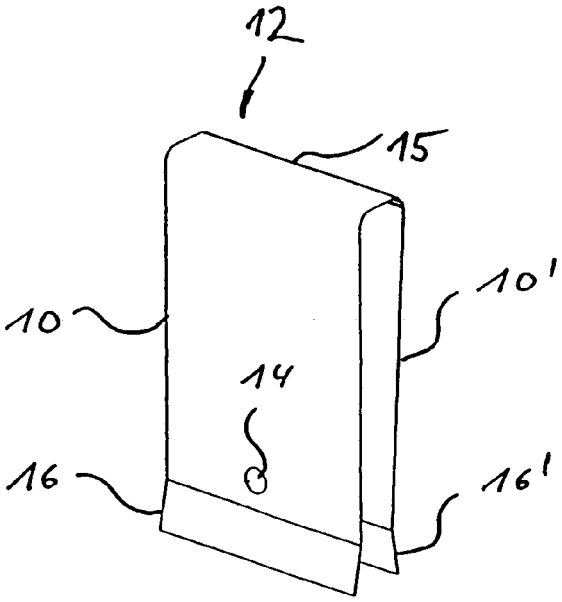
FIG. 2 is a perspective view of a first exemplary embodiment of a connecting element according the invention.

A partition wall according to the invention includes a plurality of wall elements, of which only two wall elements 2, 2' are shown in FIG. 1, and that are constructed of extruded aluminum profiles. The number of wall elements 2, 2' forming the partition wall depends on the desired length of the partition wall, outside of the wall elements 2, 2' have connecting surfaces 4, 4' for the neighboring wall elements 2 and 2' that contact each other after the wall elements 2, 2' are joined.

In the connecting surfaces 4, 4' of the wall elements 2, 2' are window-like, rectangular openings 6, 6', 6" that are arranged so that the openings 6, 6', 6" of two neighboring wall elements 2, 2' align and form a passage. Below each opening 6 in each connecting surface 4 is a hole 8 that forms a snap-in hole for a snap-in device.

The opening 6 and hole 8 are configured to enable a connecting element 12 to be inserted so that the connecting element 12 forming the first connecting device in this exemplary embodiment ensures a stable connection between wall elements 2, 2'.

The connecting element 12 of bent sheet metal is manufactured to be elastic with a thickness of approximately 0.1 cm. In this exemplary embodiment, it has a basic body with an essentially U-shaped cross-section with two legs 10, 10' that are connected by a metal bar 15, and the basic body in this exemplary embodiment is approximately 4 cm high and approximately 2.6 cm wide. When-mounted, each leg 10, 10' of connecting element 12 extends over a section of wall elements 2, 2' and elastically presses wall elements 2, 2' together.

Figure 4:
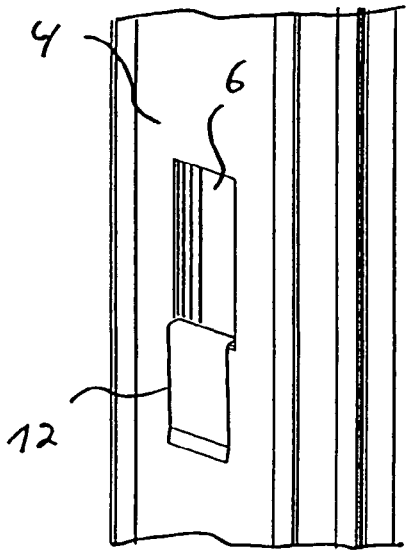
FIG. 4 is a perspective detail view of a wall element according to the invention with a mounted connecting element.

To prevent the connecting element 12 from undesirably releasing from the mounted position shown in FIG. 4, the connecting element 12 in this exemplary embodiment has snap-in device that has a snap-in projection in the form of a circular projection 14 on legs 10, 10' of the U-shaped basic body. The diameter of the projection is approximately 0.4 cm, and it is formed by a circular impression in the sheet metal of the basic body, and it can be inserted into the hole 8 of the snap-in device of the wall element 2. The projection 14 extends from a leg 10, 10' toward the other leg 10', 10.

To enable the two wall elements 2 to be separated without tools, the connecting element 12 has a bent or kinked end section 16, 16' on the two ends of the respective leg 10, 10' of the U-shaped basic body. The end section is preferably at an angle of 45° and is approximately 0.5 cm high. This kinked end section 16, 16' allows the connecting element 12 to be removed from the mounted position by grasping the kinked end sections 16, 16' and spreading the connecting element 12 so that the projection 14 is released from the hole 8, and the connecting element 12 can be removed by being lifted out of the opening 6 which separates the two wall elements 2, 2' from each other.

The assembly and disassembly of the partition wall according to the invention will be explained in the following.

To assemble a partition wall, two wall elements 2, 2' are shoved together so that their connecting surfaces 4 contact each other on the outside. The wall elements 2, 2' have two spaced openings 6, 6', 6" in their connecting surfaces 4, 4', and the openings 6, 6', 6" in wall element 2 are flush with corresponding openings in wall element 2' when in mounted position.

Figure 3:
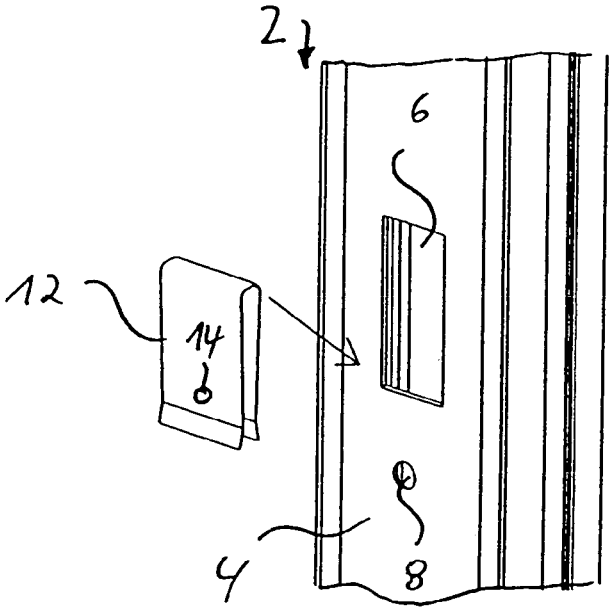
FIG. 3 is a perspective detail view of a wall element according to the invention of FIG. 1.

The connecting element 12 is then inserted into each opening 6, 6', 6" and moved to its mounted position (see FIG. 4) by spreading the connecting element 12 with the kinked end sections 16, 16', and shoved downward as illustrated in FIG. 3 until the projection 14 of the connecting element 12 snaps into the hole 8 in the wall element 2.

The two wall elements 2, 2' are thereby clamped together and form a section of a partition wall. Then additional wall elements can be added to the partition wall to extend the partition wall to the desired length.

To disassemble the partition wall, the bent end sections 16, 16' of the connecting element 12 are spread so that the projection 14 of the connecting element 12 disengages from the hole 8 of wall element 2. By then shoving the connecting element 12 in FIG. 4 upward, it can be removed from of the opening 6 in the wall elements 2, 2'. The two wall elements 2, 2' are thereby separated and can be individually carried away.

Figure 5:
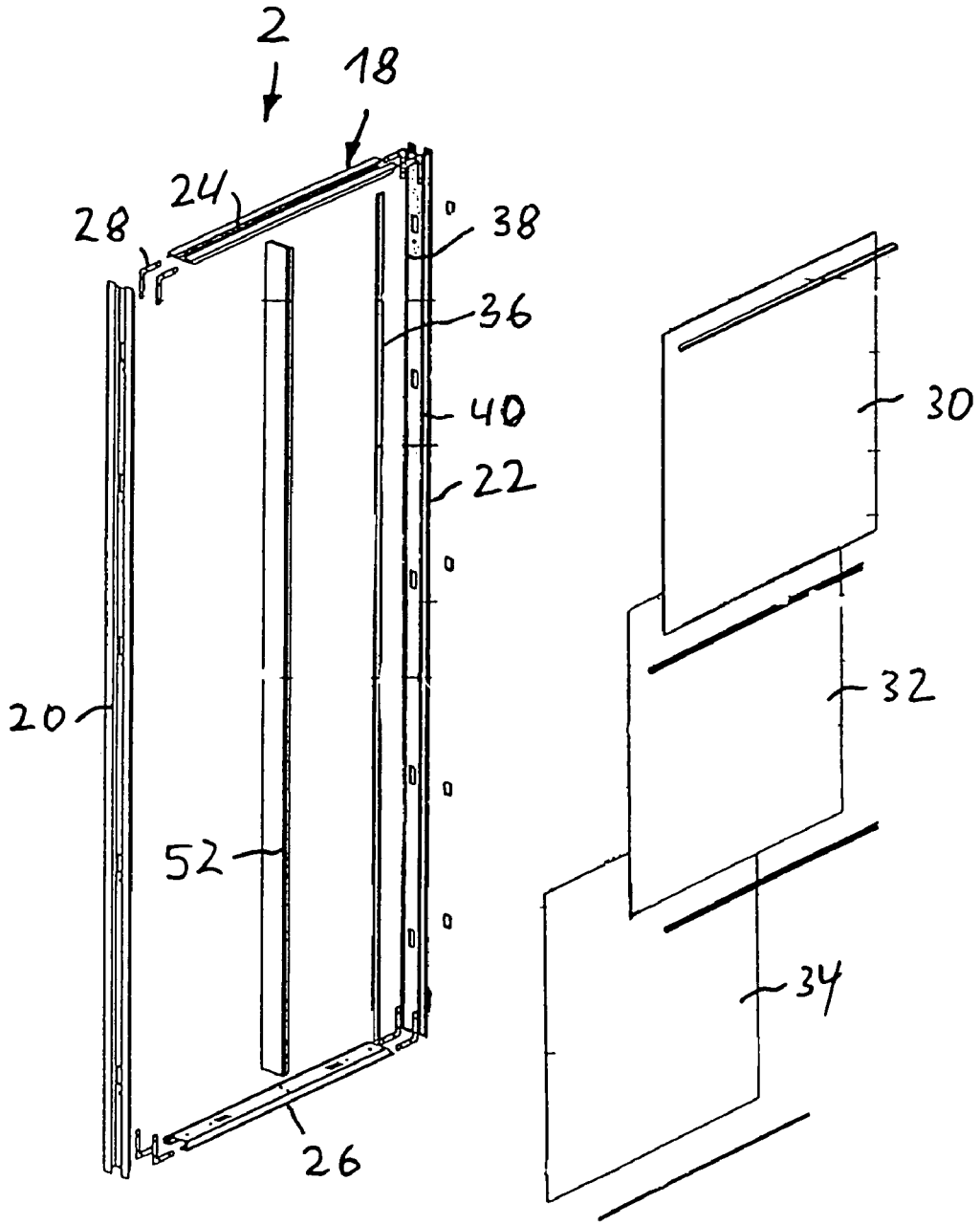
FIG. 5 is a perspective exploded view of an individual wall element according to the invention.

FIG. 5 shows an exploded view of a wall element 2 according to the invention that has a frame-like basic body 18 which in this exemplary embodiment possesses two laterally spaced side members 20, 22 that are connected by cross members 24, 26. The side members 20, 22 and the cross members 24, 26 include, in this exemplary embodiment, extruded aluminum profiles that, for example, are connected with each other by use of angle connectors to form the basic body 18. FIG. 5 only shows one connector 28.

Flat face elements 30, 32, 34 configured as visual barriers in this exemplary embodiment are also connectable to basic body 18.

Two connecting devices are provided to connect face elements 30, 32, 34 to basic body 18. The connecting devices will be further explained below. They are configured so that the face elements 30, 32, 34 and the basic body 18 can be connected and disconnected without any tools.

The second connecting device in this exemplary embodiment includes a holder 36 that in this exemplary embodiment is formed by an aluminum profile which is connectable to basic body 18 via a releasable plug-in connection that will be further explained below with reference to FIG. 6 and 7.

Figure 6:
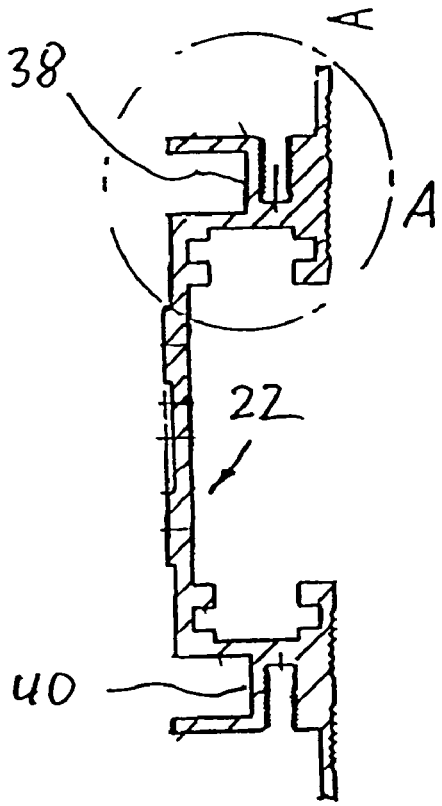
FIG. 6 is a horizontal section of a side member of a basic body of the wall element of FIG. 5.

FIG. 6 shows a horizontal section of side member 22 that is configured as an aluminum profile. The side member 22 in this exemplary embodiment has grooves 38, 40 spaced perpendicular to the length of the profile and extending the length of the profile in which the insertion end of the holder 36 can be inserted.

Figure 7:
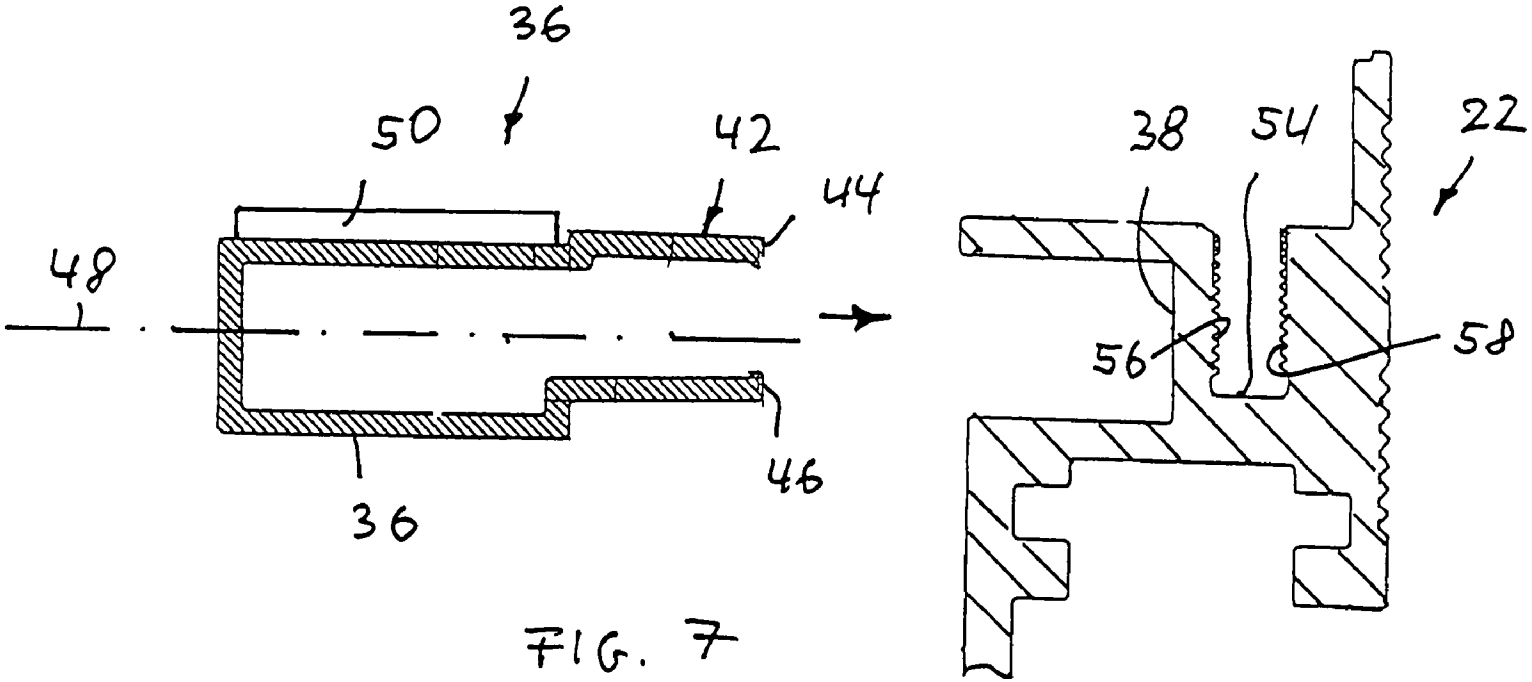
FIG. 7 is a horizontal section of a detail from the region of a plug-in connection between a holder and the side member of FIG. 6.

FIG. 7 shows an enlarged detail from FIG. 6 in the area of the groove 38, and a horizontal section of the holder 36 is shown. The holder 36 has an insertion end 42 formed by free legs 44, 46 of the aluminum profile, and its cross-section is essentially complementary with the cross-section of the groove 38. In this exemplary embodiment, the cross-section of the insertion end 42 of the holder 36 perpendicular to the lengthwise midplane 48 of the holder 36 is somewhat larger than the cross-section of the groove 38, so that the holder 36 is clamped in the groove 38 when inserted.

To connect to the holder 36 with the side member 22, the insertion end 42 of the holder 36 is inserted into the groove 38, and the legs 44, 46 are elastically deformed to a slight degree, and the holder 36 is elastically held in the groove 38.

The outer surface of the holder 36 has a part 50 of a VELCRO® connection, for example the hooked part, and the other part of the VELCRO® connection, for example the looped part, is affixed to face elements 30, 32, 34.

The face elements 30, 32, 34 are connected without tools according to the invention as follows:

First, holder 36 is inserted into the groove 40 in which it is clamped. Another holder with a configuration corresponding to holder 36 is inserted into a groove in the side member 18 (not shown in the drawing). Parts 50 of the respective VELCRO® connection on the holders 36 face the face elements 30, 32, 34. The face elements 30, 32, 34 have a complementary part of the VELCRO® connection on their side facing the holder 36. This allows the connecting elements 30, 32, 34 to be connected to and removed from the holders 36 and hence the basic body 18 via the VELCRO® strip(s).

In this exemplary embodiment, holders 36 are connected to side members 20, 22 and the face elements 30, 32, 34 are connected to holders 36 completely without tools in an easy and quick manner that saves assembly time.

If so required by the respective situation, at least one additional member 52 can be between the side members 20, 22 (see FIG. 5) that reinforces the structure, especially when the wall elements are wide.

As can be seen in FIG. 7, holder 36 in this exemplary embodiment has an additional groove 54 whose side walls in are provided with a plurality of parallel grooves 56, 58 running the length of the profile. These grooves 56, 58 in this exemplary embodiment extend the entire length of the holder 36 and serve to receive screws if components need to be affixed to the side member 22 with a screw depending on the respective situation. In this case, screws can be screwed into any location in the side member 22 viewed from the lengthwise direction of the side member 22.

Figure 8:
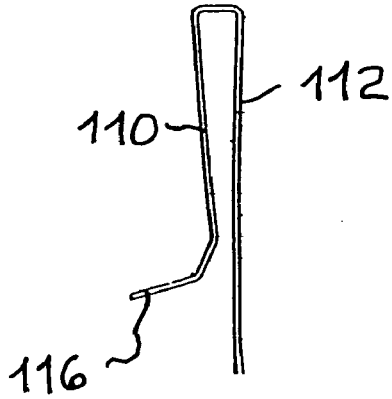
FIG. 8 is a side view of another exemplary embodiment of a connecting element according to the invention.

FIG. 8 shows a second exemplary embodiment of a connecting element 112 according to the invention that differs from the exemplary embodiment in FIGS. 1-4 in that it does not have a projection 14. In addition, the exemplary embodiment of the connecting element 112 in FIG. 8 differs from that in FIGS. 1-4 in that an end section 116 of a leg 110 of connecting element 112 has a stronger or greater curve or bend to make it easier to grip the end section to spread the connecting element 112 when releasing the connecting elements 112 from the wall elements 2, 2'. In this exemplary embodiment, connecting element 112 includes spring band steel.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. Wall element for constructing a partition, the wall element comprising:

a) a first connecting device, the first connecting device including a first connecting element configured for establishing a connection with another wall element;

b) the first connecting device being configured for connecting the one wall element with the other wall element without tools;

c) a substantially frame-like basic body;

d) a second connecting device being configured for releasably connecting a flat face element with the basic body; and e) the second connecting device being configured so that the one flat face element can be connected with the basic body without tools;

f) the wall element has a window-like opening that receives the first connecting element;

g) the first connecting element has a clamping device to clamp the one wall element to the other wall element;

h) the first connecting element includes one of a bracket and clamp to form the clamping device; and i) the first connecting element includes two spaced apart legs, and the legs are connected via a middle bar.

2. Wall element according to claim 1, wherein:

a) the first connecting device is configured so that the wall element can be disconnected from the other wall element without tools.

3. Wall element according to claim 2, wherein:

a) the second connecting device has a holder for the face element, and the holder is connectable to the basic body without tools.

4. Wall element according to claim 3, wherein:

a) the holder is connectable to the basic body via a releasable plug-in connection.

5. Wall element according to claim 3, wherein:

a) the basic body includes a groove in which the insertion end of the holder can be inserted.

6. Wall element according to claim 5, wherein:

a) the holder can be clamped in the groove in the insertion position.

7. Wall element according to claim 6, wherein:

a) the cross-section of the insertion end is substantially complementary with the cross-section of the groove.

8. Wall element according to claim 3, wherein:

a) the holder is formed by a profiled element.

9. Wall element according to claim 3, wherein:

a) the face element is connectable to the holder without tools.

10. Wall element according to claim 9, wherein:

a) the face element is connectable to the holder with a hook-and-loop fastener, and a hook of the hook-and-loop fastener is on one of the components to be connected, and a loop part of the hook-and-loop fastener is on another of the components to be connected.

11. Wall element according to claim 1, wherein:

a) the legs are elastic and form the clamping device.

12. Wall element according to claim 1, wherein:

a) the first connecting element includes a snap-in device to secure the first connecting element in an opening provided on one of the wall elements, in use.

13. Wall element according to claim 1, wherein:

a) one of the legs includes one of a bent and an angled end section on a free end that can be spread by grasping the one of a bent and an angled end section.

* * * * *